US009491554B2

(12) United States Patent
Sundberg et al.

(10) Patent No.: US 9,491,554 B2
(45) Date of Patent: Nov. 8, 2016

(54) HEARING AID DEVICE WITH INTEGRATED ANTENNA

(71) Applicant: Oticon A/S, Smørum (DK)

(72) Inventors: Oliver Sundberg, Smørum (DK); Jens Troelsen, Smørum (DK); Bjarne Kielsholm-Ribalaygua, Smørum (DK)

(73) Assignee: OTICON A/S, Smørum (DK)

( * ) Notice: Subject to any disclaimer, the term of this patent is extended or adjusted under 35 U.S.C. 154(b) by 76 days.

(21) Appl. No.: 14/491,326

(22) Filed: Sep. 19, 2014

(65) Prior Publication Data

US 2015/0078599 A1 Mar. 19, 2015

(30) Foreign Application Priority Data

Sep. 19, 2013 (EP) ..... 13185193

(51) Int. Cl.
*H04R 25/00* (2006.01)
*H01Q 1/27* (2006.01)
*H01Q 1/40* (2006.01)

(52) U.S. Cl.
CPC ..... *H04R 25/554* (2013.01); *H01Q 1/273* (2013.01); *H01Q 1/40* (2013.01); *H04R 25/00* (2013.01); *H04R 2225/51* (2013.01); *H04R 2225/63* (2013.01)

(58) Field of Classification Search
USPC ..... 381/315, 312
See application file for complete search history.

(56) References Cited

U.S. PATENT DOCUMENTS

| | | | | |
|---|---|---|---|---|
| 7,443,991 | B2 * | 10/2008 | Niederdrank et al. | 381/315 |
| 2008/0170739 | A1 * | 7/2008 | Suematsu et al. | 381/380 |
| 2009/0196449 | A1 * | 8/2009 | Platz | 381/330 |
| 2010/0321269 | A1 * | 12/2010 | Ishibana | H01Q 1/273 343/834 |
| 2011/0022121 | A1 | 1/2011 | Meskins | |
| 2011/0116669 | A1 | 5/2011 | Karunasiri | |
| 2012/0148079 | A1 | 6/2012 | Gabathuler et al. | |
| 2013/0223664 | A1 | 8/2013 | Meskens et al. | |
| 2014/0010394 | A1 * | 1/2014 | Kvist | 381/315 |

* cited by examiner

*Primary Examiner* — Davetta W Goins
*Assistant Examiner* — Amir Etesam
(74) *Attorney, Agent, or Firm* — Birch, Stewart, Kolasch & Birch, LLP

(57) ABSTRACT

A hearing aid device configured to communicate wirelessly with an external device is disclosed. The hearing aid device comprises a housing with a microphone, an amplifier, where the hearing aid device comprises an antenna and either: a) a tube configured to deliver sound acoustically from a receiver in the housing to an ear mold or a dome or electrically to a receiver in an ear mold or a dome or b) a hook configured to deliver sound acoustically from a receiver in the housing to an ear mold or a dome. The antenna extends along at least a portion of the tube or the hook.

16 Claims, 15 Drawing Sheets

2
4
20
94
96
100
98
20'
20''
80
82
42
10
10'
76
78
34
102
104

HEARING AID DEVICE WITH INTEGRATED ANTENNA

FIELD OF DISCLOSURE

The present disclosure generally relates to a hearing aid device. The disclosure more particularly relates to a hearing aid device that is configured to communicate wirelessly with an external device.

PRIOR ART

Recent hearing aid devices are adapted for communicating wirelessly with external devices. It is known to configure a hearing aid device to transmit a wireless signal to a corresponding hearing aid device (arranged in the other ear) in order to simultaneously change e.g. background settings of two hearings aid devices arranged in the both ears of a user.

It is also known to use wireless technology standards for exchanging data over short distances by using short-wavelength radio transmissions, such as Bluetooth applying the ISM band from 2400-2480 MHz.

When hearing aid device has to be configured to perform wireless communication there are a number of specific requirements to be considered, such as the size and position of the antenna.

Thus, there is need for a hearing aid device that makes it possible to provide effective wireless communication with an external device.

It is an object of the present disclosure to provide an effective way of arranging an antenna within a hearing aid device and to provide a hearing aid device capable of providing effective wireless communication with an external device.

SUMMARY OF THE DISCLOSURE

The object of the present disclosure can be achieved by a hearing aid device as defined in claim 1. Preferred embodiments are defined in the dependent sub claims and explained in the following description and illustrated in the accompanying drawings.

The hearing aid device according to the disclosure is a hearing aid device configured to communicate wirelessly with an external device, where the hearing aid device comprises a housing with a microphone and an amplifier, where the hearing aid device further comprises an antenna and either:

a) a tube configured to deliver sound acoustically from a receiver in the housing to an ear mould or a dome or electrically to a receiver in an ear mould or a dome or b) a hook configured to deliver sound acoustically from a receiver in the housing to an ear mould or a dome.

The antenna extends along at least a portion of the tube or the hook.

Such hearing aid device makes it possible to provide effective wireless communication with an external device. Moreover it is possible to arrange the antenna within a hearing aid device in a manner that facilitates effective wireless communication with an external device.

The hearing aid device according to the disclosure is a hearing aid device configured to communicate wirelessly with an external device. The external device may in principle be any suitable device e.g. a mobile phone, a computer, another hearing aid, a remote control, a wireless relay device adapted to advance an audio signal from another communication application, or the like.

The hearing aid device may be configured to communicate wirelessly by using any wireless technology, however, it may be an advantage to use a wireless technology standard for exchanging data over short distances by using short-wavelength radio transmissions, e.g. Bluetooth applying the ISM band from 2400-2480 MHz.

The hearing aid device comprises a housing (which also may be referred to as a casing) with a microphone and an amplifier.

The hearing aid device may comprise several microphones and the microphone(s) may be of any suitable type.

The amplifier may be of any suitable type.

The housing may also comprise a receiver configured to generate acoustic sound waves.

It may be preferred that the housing is configured to receive a battery for delivery of energy to the hearing aid device.

The antenna may be any suitable type of antenna made in any suitable material and having any suitable form.

The hearing aid device may comprise a tube configured to deliver sound acoustically from a receiver in the housing to an ear mould or a dome or electrically to a receiver in an ear mould or a dome.

The hearing aid device may comprise a hook configured to deliver sound acoustically from a receiver in the housing to an ear mould or a dome.

The hearing aid device may be a receiver-in-the-ear (RITE) hearing aid device or a behind-the-ear (BTE) hearing aid device by way of example.

The antenna extends along at least a portion of the tube or the hook and hereby it is possible to facilitate effective wireless communication with an external device.

In the present context, a "hearing aid device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

A "hearing aid device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve and/or to the auditory cortex of the user.

A hearing aid device may be configured to be worn in any known way, e.g. as a unit arranged behind the ear with a tube leading air-borne acoustic signals into the ear canal or with a loudspeaker arranged close to or in the ear canal, as a unit entirely or partly arranged in the pinna and/or in the ear canal. A hearing device may comprise a single unit or several units communicating electronically with each other.

More generally, a hearing aid device comprises an input transducer for receiving an acoustic signal from a user's surroundings and providing a corresponding input audio signal and/or a receiver for electronically receiving an input audio signal, a signal processing circuit for processing the input audio signal and an output means for providing an audible signal to the user in dependence on the processed audio signal. Some hearing aid devices may comprise multiple input transducers, e.g. for providing direction-dependent audio signal processing. In some hearing aid devices, the receiver may be a wireless receiver. In some hearing aid devices, the receiver may be e.g. an input amplifier for receiving a wired signal. In some hearing aid devices, an amplifier may constitute the signal processing circuit. In some hearing aid devices, the output means may comprise an output transducer, such as e.g. a loudspeaker for providing an air-borne acoustic signal or a vibrator for providing a structure-borne or liquid-borne acoustic signal. In some hearing aid devices, the output means may comprise one or more output electrodes for providing electric signals.

In some hearing aid devices, the vibrator may be adapted to provide a structure-borne acoustic signal transcutaneously or percutaneously to the skull bone. In some hearing aid devices, the vibrator may be implanted in the middle ear and/or in the inner ear. In some hearing aid devices, the vibrator may be adapted to provide a structure-borne acoustic signal to a middle-ear bone and/or to the cochlea. In some hearing aid devices, the vibrator may be adapted to provide a liquid-borne acoustic signal in the cochlear liquid, e.g. through the oval window. In some hearing aid devices, the output electrodes may be implanted in the cochlea or on the inside of the skull bone and may be adapted to provide the electric signals to the hair cells of the cochlea, to one or more hearing nerves and/or to the auditory cortex.

It may be an advantage that the antenna extends along at least a portion of the hook and that the antenna is embedded into the wall of the hook.

Hereby it is possible to provide a reliable antenna that is secured to the wall of the hook.

It may be beneficial that the antenna comprises several separate antenna members that are electrically connected to each other to form one interconnected antenna.

In this way it is possible to have an antenna that extends through several members that are configured to be attached to each other and to be detached from each other. This option provides great design freedom.

The connections between adjacent antenna members may be of any suitable plug or type of connection It may be advantageous that the hearing aid device comprises a tube and an antenna that comprises an antenna portion formed as a coaxial sleeve encasing at least a portion of the tube.

Accordingly, it is possible to install such antenna on existing tubes subsequently. Moreover, it is possible to provide an effective and easy installable antenna that easily can be inspected.

It may be an advantage that the antenna is provided in a recess in the hook or in the tube.

Hereby a simple and reliable attachment of the antenna to the hook or to the tube can be provided.

It may be an advantage that the antenna is provided in a recess provided in the outer surface of the hook or in the tube. Hereby the mounting of the antenna into the recess is eased.

It may beneficial that the hearing aid device comprises a support arm configured to support and fixedly secure the antenna to the tube or the hook. Such construction is easy to use and provides optimum access for inspection of the antenna.

It may be an advantage that the hearing aid device is a RITE hearing aid device comprising a connection member comprising a support arm that is provided as extension of the connection member.

It may be beneficial that the support arm is configured to be mechanically (detachably) attached to the tube by means of two holding arms that are provided at the distal end of the support arm.

It may be preferable that each of the holding arms is shaped as a portion (e.g. 120 degrees) of a hollow circular cylinder and that the holding arms are arranged in such a way that they constitute an attachment space provided between the holding arms and that the attachment space is configured to receive and hereby secure the tube to the support arm.

It may be beneficial that the hearing aid device comprises a tube and that a thin (thinner than the wall of the tube) antenna is provided at the inner surface of the tube.

It may be an advantage that the antenna is provided as a thin film.

The antenna may be attached to the tube by any suitable means. The tube may be produced by extrusion by way of example.

It may be advantageous that the hearing aid device comprises a tube that has a basically circular cross-section, where several antennas are embedded in the wall of the tube and extend along the length of the tube.

Hereby it is possible to provide a reliable and robust hearing aid device in which the antenna is firmly secured to the tube.

It may be an advantage that the tube is provided with an increased thickness portion in which a first thin (thinner than the wall thickness of the tube) antenna, a second thin antenna and a third thicker antenna are provided.

It may be an advantage that the antennas are embedded in the wall of the tube and extend along the length of the tube.

It may be beneficial that the hearing aid device comprises a tube having a head member provided with outer threads and that an antenna covers a portion of the threads of the head member and that the antenna is electrically connected to another antenna member that is attached to the outer surface of the tube, where the hearing aid device comprises a connection member having a cavity configured to receive the tube, where the cavity is provided with inner threads configured to receive the threads of the head member, where a first antenna member extends through the connection member and where the first antenna is electrically connected to a second antenna that covers a portion of threads of the connection member.

Hereby a reliable and simple hearing aid can be provided. At the same time a good electrical connection between the first antenna and the second antenna can be achieved.

It may be beneficial that the hearing aid device comprises a housing with an antenna and that a groove member is provided in the first antenna and that the groove member is configured to receive a corresponding tongue member provided in the antenna of the housing.

Hereby a simple and reliable connection between the two antennas can be achieved.

It may be an advantage that a tongue member is provided in the proximal end of the connection member and that a groove member corresponding to the tongue member is provided in the housing. The connection member may preferably be configured to be mechanically and electrically connected to the housing of the hearing aid device by means of the tongue members and the corresponding groove members.

Hereby a reliable and secure connection can be provided between the connection member and the housing. Besides when the hearing aid device is assembled, all the antennas are electrically connected to form one large antenna capable for being used to perform wireless communication with an external device (e.g. a mobile phone).

Some of the tongue members and the corresponding groove members may be replaced by other attachment members or plug members.

It may be advantageous that the hearing aid device comprises a tube and a head member, where the head member is provided with threads for being screwed into a threaded connection member, where the hearing aid device comprises a pipe member, where antenna is attached to the pipe member, where the hearing aid device comprises a knife member and that the antenna is configured to be arranged in the pipe by inserting the knife member into the wall of the tube.

Hereby a secure and reliable attachment of the tube to the connection member can be achieved.

It may be beneficial that the pipe member is made in an electrically conductive material in order to provide an electrical connection to the housing of the hearing aid device.

It may be an advantage that the head member comprises an electrical connection portion suitable of providing an electrical connection to the housing of the hearing aid device.

It may be beneficial that the hearing aid device comprises a connection member and a tube that is attached to a head member having threads, which head member is configured to be received by inner threads of the connection member, where a first antenna extends along the threads of the head member and is electrically connected to a second antenna that is provided at the outside surface of the tube.

Moreover it may be an advantage that the second antenna is twisted around the tube to form a coil-like member.

Hereby, the second antenna takes up less space than a straight antenna.

It may be beneficial that the hearing aid device comprises a tube having a head member and that an antenna is provided at the outside surface of the tube and that the antenna extends along the length of the tube, where the antenna extends from the head member along the proximal portion of the tube.

It may be an advantage that the antenna coves basically one half of the outside surface of the tube. The antenna may be an indium tin oxide (ITO) coating or any other suitable type of antenna.

It may be beneficial that the antenna covers the entire outside surface of the tube. Thus, the antenna encloses the tube. The antenna may be an ITO coating or any other suitable type of antenna.

It may be an advantage that a head member is provided outside the antenna and that the antenna extends along the inside of the head member and extends further along the proximal portion of the tube.

It may be beneficial that the hearing aid device comprises a tube and that a flat plate-shaped antenna is embedded in the wall of the end portion of the tube.

It may be an advantage that the tube is flexible and comprises an increased thickness portion at its distal end.

Moreover it may be beneficial that a flat plate-shaped antenna is embedded in the wall of the increased thickness portion of the tube.

It may be beneficial that a box-shaped connection body is attached to the underside of the distal portion of the antenna.

Further it may be an advantage that the distal end surface of the antenna and the connection body are aligned.

It may be beneficial that the connection body is a gold pad.

It may be beneficial that the hearing aid device comprises a tube that comprises walls and has a circular cross-section and that the tube comprises a centrally arranged antenna having a circular cross-section.

Further it may be an advantage that the antenna is a litz wire antenna.

It may be an advantage that the hearing aid device comprises a head member provided with threads for being screwed into a threaded connection member and that the head member is attached to a basically cylindrical pipe member and that an antenna is attached to the pipe member.

Further it may be an advantage that the hearing aid device comprises a knife member and an antenna arranged in the pipe and that the knife member is configured to be inserted into the wall of the tube.

It may be an advantage that the hearing aid device comprises a tube having a basically circular cross-section and that the tube is provided with a flat portion configured to receive a plate-shaped antenna.

Hereby the antenna may simply be attached to the flat portion of the tube by means of glue.

It may be preferred to provide the antenna with a coating, e.g. a protective coating.

It may be an advantage that the hearing aid device comprises a flexible tube comprising a wall and an antenna and that the antenna comprises a so-called "Kevlar antenna wire" comprising continuous filament aramid and tinned copper wire braid.

It may be beneficial that the hearing aid device comprises a tube and that a pair of holding arms is provided at the outer surface of the tube.

Further it may be an advantage that the holding arms are configured to receive and maintain an antenna secured to the tube.

It may be beneficial that the antenna has a circular cross section and is attached to the tube by means of an interference fit.

It may be advantageous that the hearing aid device comprises a tube comprising a first half and a second half that are configured to be joint and that a first recess is provided in the first half and that a second recess is provided in the second half.

It may be beneficial that the antenna has a circular cross section.

It may be an advantage that the two half's are attached to each other by means of glue.

It is possible to glue the two half's together or to join the by using any other suitable method.

DESCRIPTION OF THE DRAWINGS

The disclosure will become more fully understood from the detailed description given herein below. The accompanying drawings are given by way of illustration only, and thus, they are not limitative of the present disclosure. In the accompanying drawings.

DETAILED DESCRIPTION OF THE DISCLOSURE

Figure 1A:
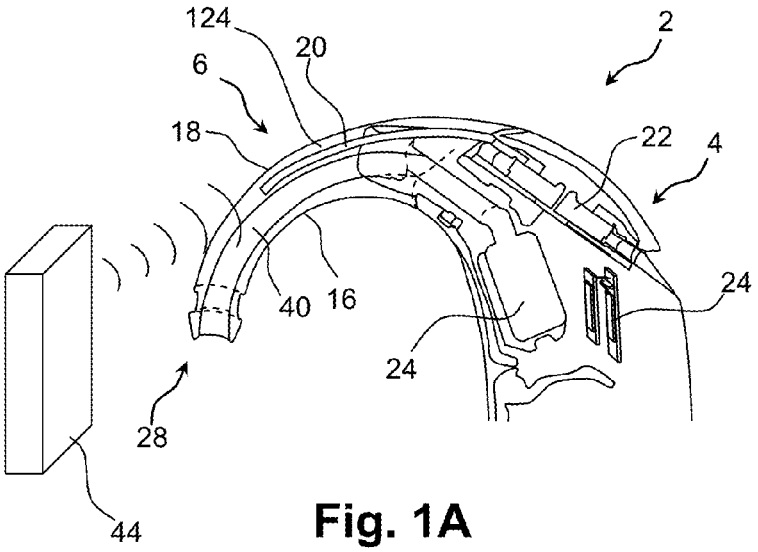
FIG. 1A shows schematically a cross-sectional view of a hearing aid device according to the disclosure.
Figure 1B:
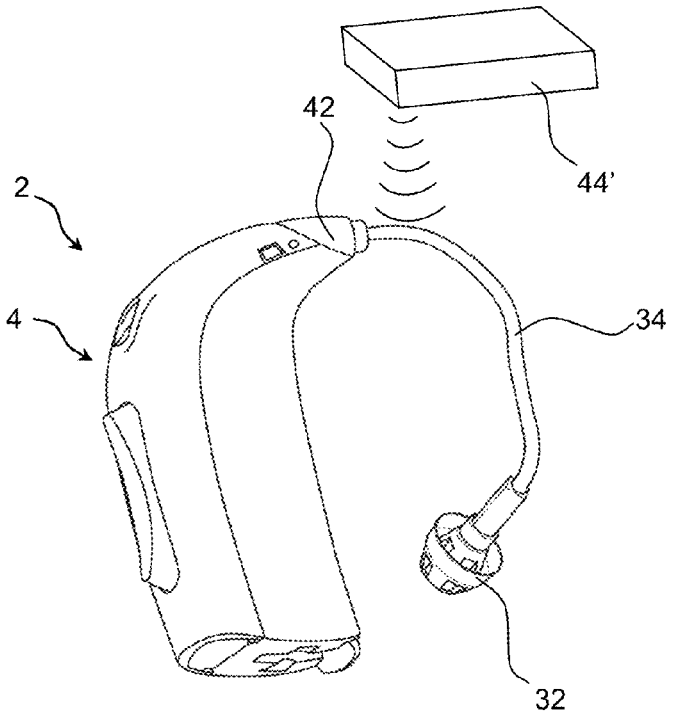
FIG. 1B shows schematically views of another hearing aid device according to the disclosure.

Referring now in detail to the drawings for the purpose of illustrating preferred embodiments of the present disclosure, different views of a hearing aid device 2 according to the disclosure is illustrated in FIGS. 1A-1B.

FIG. 1A illustrates schematically a cross-sectional view of a hearing aid device 2 according to the disclosure. The hearing aid device is a BTE hearing aid device 2 comprising a housing 4 with a microphone member 22, an amplifier 24 and a receiver 26. A hook 6 is mechanically attached to the housing 4.

The hook 6 has an upper side 18, a lower side 16 and a distal end 28. The distal end 28 is configured to receive an ear mould (see FIG. 5B). The hook 6 is provided with a through-going bore 40 through which air-borne acoustic sound is transferred from the receiver 26 to the ear of the user via the ear mould (see FIG. 6B).

The antenna 20 extends along the upper side 18 of the hook 6. It is possible to embed (e.g. by a moulding process) the antenna 20 into the wall 124 of the hook 6 or to provide an alternative attachment. The antenna 20 is required in order to perform wireless communication with an external device 44 (e.g. a mobile phone).

FIG. 1B illustrates schematically a view of another hearing aid device 2 according to the disclosure. The hearing aid device 2 is a RITE hearing aid device 2 comprising a housing 4 and a tube 24 that is connected to the housing via a connection member 42 attached to the housing 4. A dome 32 is attached to the distal end of the pipe 34.

Figure 13C:
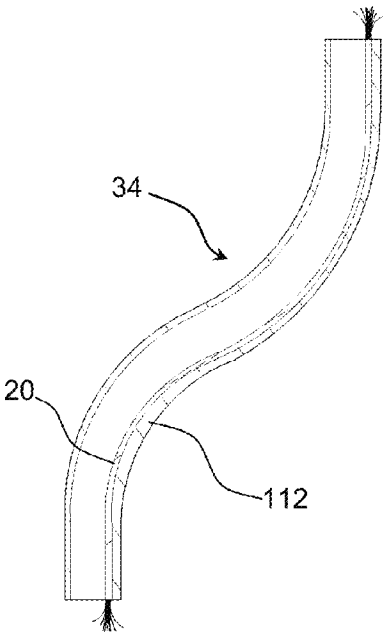
FIG. 13C shows schematically a cross-sectional view of a further tube according to the disclosure.
Figure 14B:
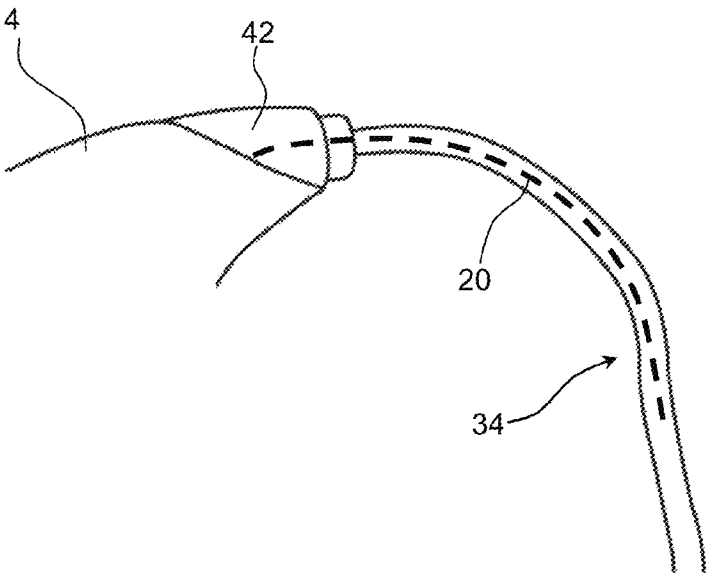
FIG. 14B shows schematically a side view of a housing of a hearing aid according to the disclosure and FIGS. 15A-15B shows two schematically cross-sectional views of a tube according to the disclosure.

An antenna (not shown) extends from the housing 4 through the proximal portion of the tube 34 (see FIG. 13C) and FIG. 14B). Accordingly, the hearing aid device 2 is configured to communicate wirelessly with the external device 44'.

The hearing aid devices 2 may be configured to communicate wirelessly by using any wireless technology, however, it may be an advantage to apply a wireless technology standard for exchanging data over short distances such as Bluetooth applying short-wavelength radio transmissions in the ISM band from 2400-2480 MHz.

Figure 2A:
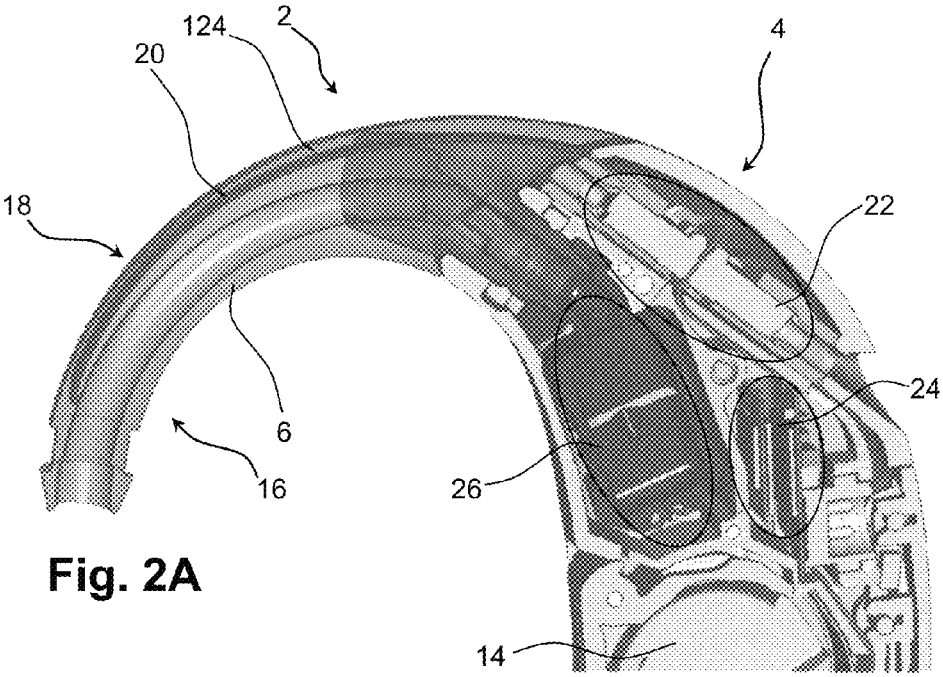
FIG. 2A shows a cross-sectional view of a BTE hearing aid device according to the disclosure.
Figure 2B:
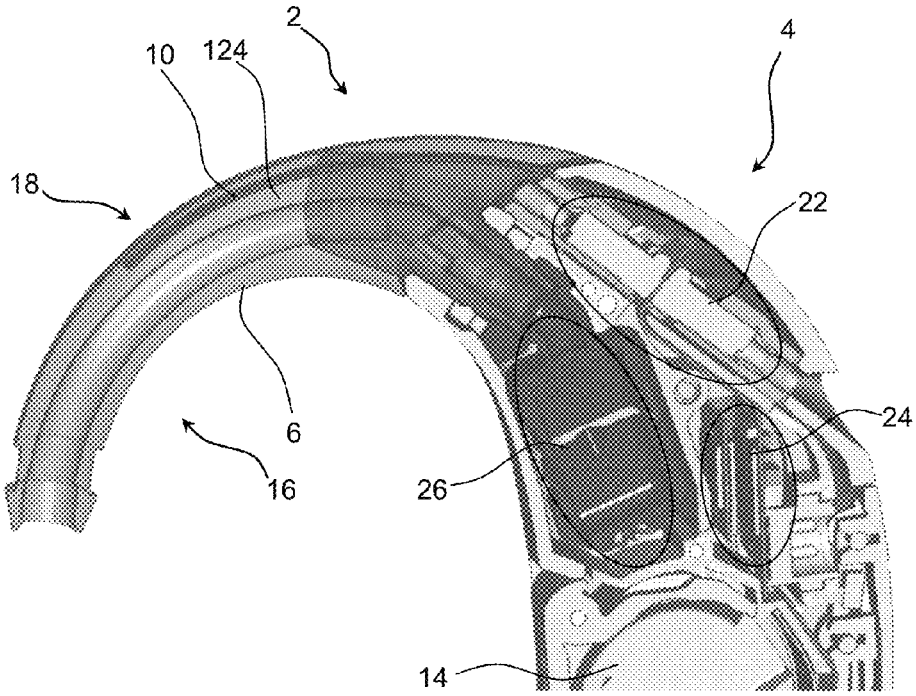
FIG. 2B shows a cross-sectional view of another BTE hearing aid device according to the disclosure.

FIGS. 2A-2B illustrates two schematically views of a hearing aid devices 2 according to the disclosure. FIG. 2A is a cross-sectional view of a BTE hearing aid device 2 comprising a relative long antenna 20 that is embedded into wall 124 of the hook 6.

The hearing aid device 2 corresponds basically to the one shown in FIG. 1A and it comprises a housing 4 with a microphone member 22, an amplifier 24, a receiver 26 and a hook 6 that is mechanically attached to the housing 4.

Figure 5B:
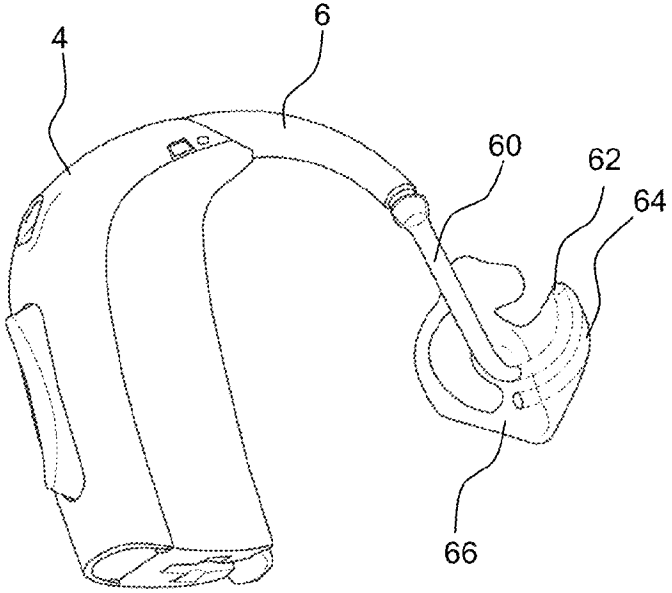
FIG. 5B shows another perspective view of the BTE hearing aid device shown in FIG. 5A.

The hook 6 has an upper side 18; a lower side 16 and a distal end 28 that is open and is configured to receive an ear mould (see FIG. 5B). The hook 6 is provided with a through-going bore 40 for transferring air-borne acoustic sound from the receiver 26 to the ear of the user via the ear mould (see FIG. 6B).

FIG. 2B is a cross-sectional view of another BTE hearing aid device 2 comprising a relative short antenna 10 that is embedded into the wall 124 of the hook 6. The only difference between the two hearing aid devices 2 shown in FIG. 2A and FIG. 2B is the length of the antennas 10, 20.

FIGS. 3A-3D illustrates schematically cross-sectional views of four different hooks 6 according to the disclosure. The hooks 6 are configured to be used in BTE hearing aid devices 2 like the ones illustrated in FIGS. 2A-2B.

The hooks 6 comprise an upper side 18 (that is concave in FIGS. 3A-3D) and a lower side 16 (that is convex in FIGS. 3A-3D). The hooks 6 have a proximal end 36 provided with a connection body 46 configured to be inserted into a housing of a BTE hearing aid like illustrated in FIGS. 2A-2B. The hooks 6 moreover comprise a distal end 28 configured to receive an ear mould (see FIG. 5B). Besides, each of the hooks 6 are provided with a through-going bore 40.

Figure 3A:
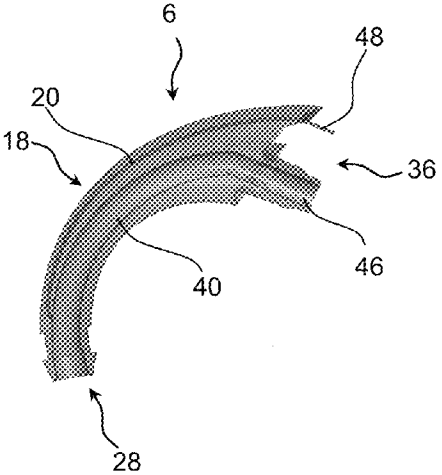
FIGS. 3A-3D shows schematically cross-sectional views of four different hooks according to the disclosure.

FIG. 3A illustrates a first hook 6 provided with a long, thin rod-shaped antenna 20 extending along the periphery of the upper side 18 of the hook 6. The antenna 20 comprises a protruding member 48 that protrudes from the proximal end 36 of the hook 6. The protruding member 48 is configured to be connected to the housing of a BTE hearing aid device.

Figure 3B:
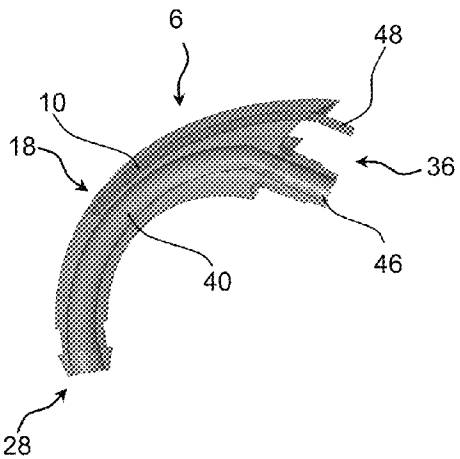

FIG. 3B illustrates a second hook 6 provided with a short, flat antenna 10 that extends along the periphery of the upper side 18 of the hook 6. The antenna 20 comprises a protruding member 48 that protrudes from the proximal end 36 of the hook 6. The protruding member 48 is adapted to be connected to the housing of a BTE hearing aid device.

Figure 3C:
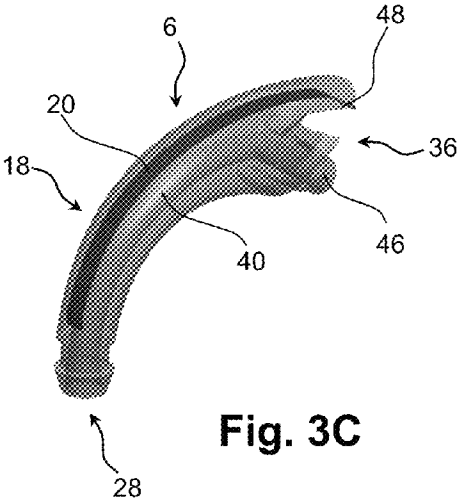

FIG. 3C illustrates a third hook 6 provided with a long, thin and flat antenna 20 that extends along the periphery of the upper side 18 of the hook 6. The antenna 20 comprises a protruding member 48 configured for connection with the housing of a BTE hearing aid device.

Figure 3D:
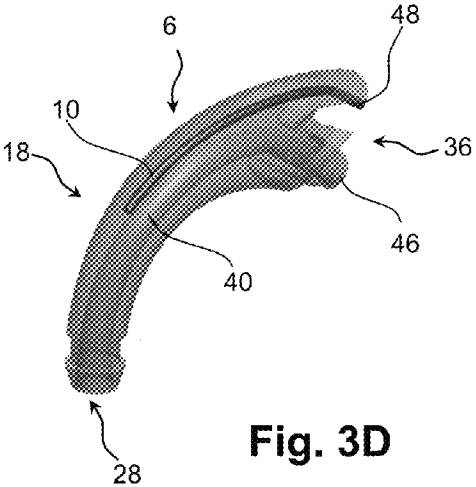

FIG. 3D illustrates a fourth hook 6 provided with a short rod-shaped antenna 10 that extends along the periphery of the upper side 18 of the hook 6. The antenna 20 has a protruding member 48 that protrudes from the proximal end 36 of the hook 6 and that is configured to be connection with the housing of a BTE hearing aid device.

The antennas 10, 20 may be arranged within the hooks 6 during the manufacture of the hooks (e.g. by means of injection moulding). It is also possible to attach the antenna 10, 20 within the hook 6 afterwards e.g. by means of a mechanical attachment, gluing or by applying another suitable attachment method.

Figure 4B:
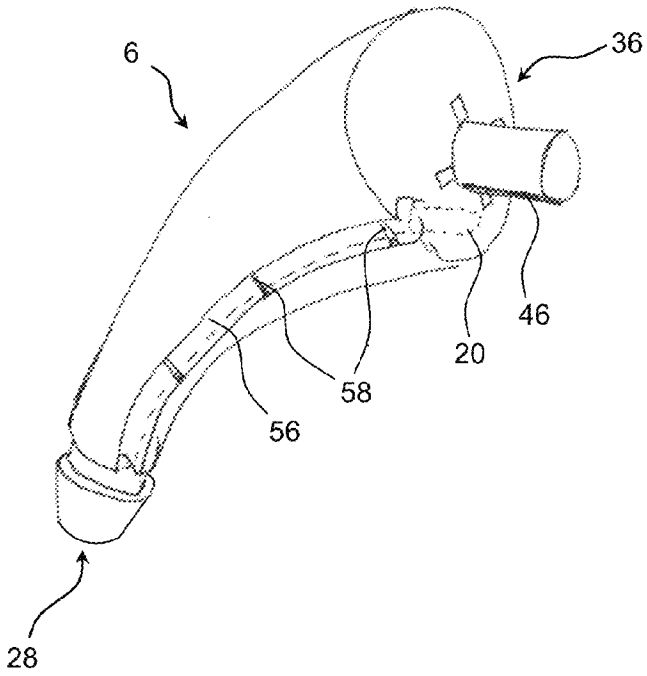
FIG. 4B shows schematically a perspective view of a hook of a hearing aid device according to the disclosure.
Figure 4A:
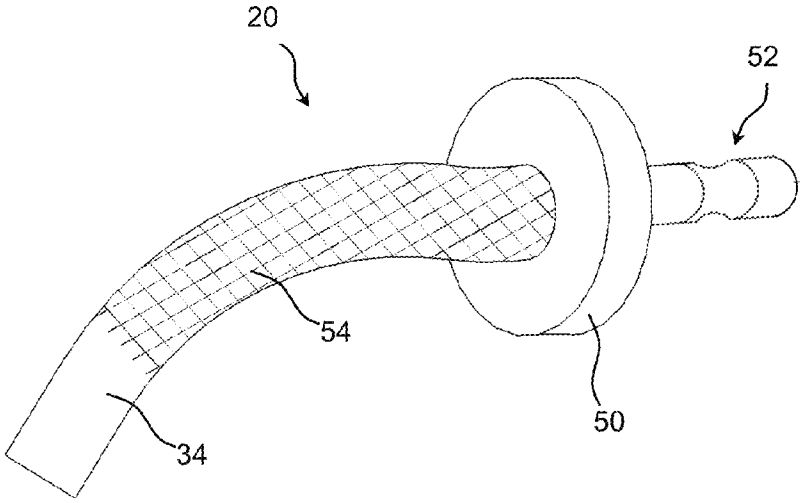
FIG. 4A shows schematically a perspective view of an antenna according to the disclosure.

FIG. 4A illustrates schematically a perspective view of an antenna 20 provided as a coaxial sleeve 54 arranged outside a tube 34. The antenna 20 is connected to a ring-shaped ring member 50 and the coaxial sleeve 54 is electrically connected to a connection member 52 adapted for being connected to a hearing aid device. The tube 34 may be provided within a hook 6 of a BTE hearing aid device or be arranged in a RITE hearing aid.

FIG. 4B illustrates schematically a perspective view of a hook 6 of a hearing aid device according to the disclosure. The hook 6 is provided with a recess 56 configured to receive an antenna 20. The recess 56 extends from the distal end 28 of the hook 6 to the proximal end 35 of the hook 6. A basically cylindrical connection member 46 is provided at the proximal end 35 of the hook 6.

An antenna 20 is indicated by a dotted line. Three ribs 58 are provided along the recess 56. The ribs 58 are configured to keep the antenna 20 in place within the recess 56.

Figure 5A:
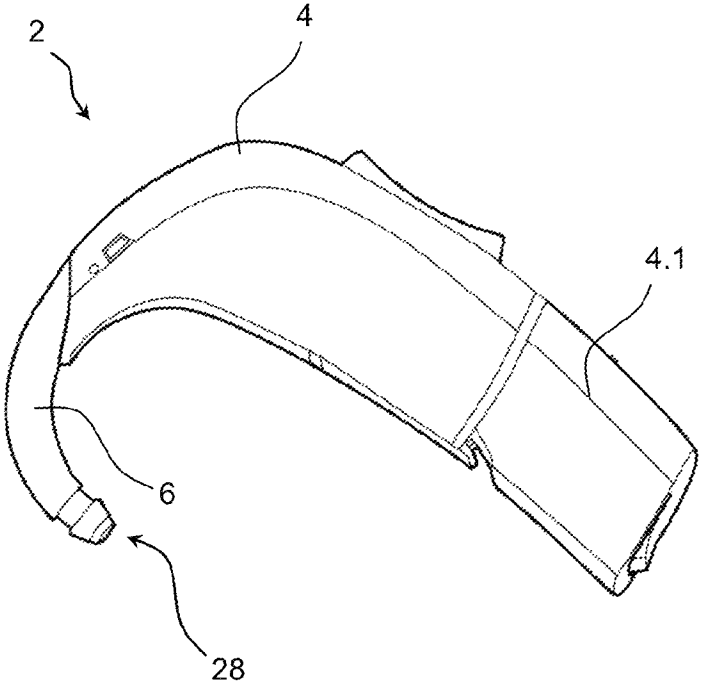
FIG. 5A shows a perspective view of a BTE hearing aid device according to the disclosure.

FIG. 5A illustrates a perspective view of a BTE hearing aid device 2 according to the disclosure. The BTE hearing aid device 2 comprises a housing 4 and a hook 6 having a distal end 28 configured to receive an ear mould 66 (see FIG. 5B). An add on part 4.1 is shown connected to the housing 4. The add on part 4.1 may comprise a radio transceiver means or may comprise direct audio input connection means adapted to be connected to a wired audio source. The add on device may utilize the antenna of the hearing aid such that the add on device may be kept at a limited size.

FIG. 5B illustrates a perspective view of the BTE hearing aid device 2 shown in FIG. 5A. A tube 60 is attached to the distal end 28 of the hook 6. The tube 60 is configured to transfer acoustic sound from the receiver within the housing 4 of the BTE hearing aid device 2. An ear mould 66 having a ventilation opening 64 and a sound outlet 62 is attached to the distal end of the tube 60. Air-borne acoustic sound from the receiver is transferred to ear of the user of the hearing aid device 2 through the sound outlet 62, when the ear mould 66 is arranged in the ear of the user.

The antenna is not visible in FIGS. 5A-5B since it extends within the hook 6. It would, however, be possible to let the antenna extend along a portion of the tube 60 e.g. by using an antenna as illustrated in FIG. 4B.

Figure 6B:
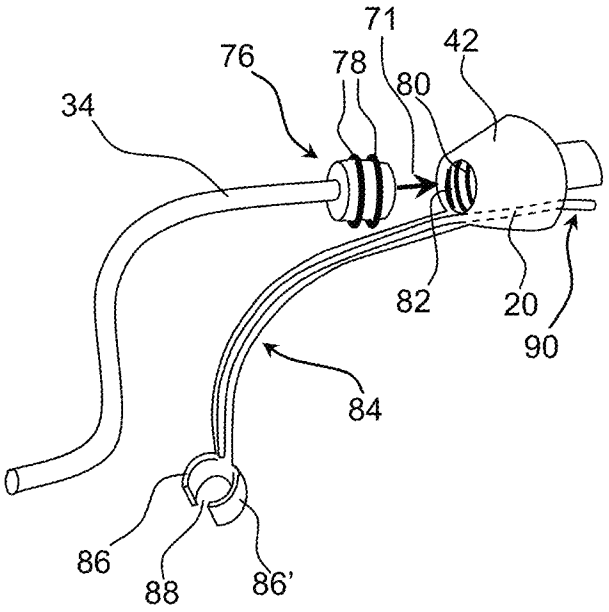
FIG. 6B shows schematically a perspective view of a tube and a connection member of the type that is intended to be used in a RITE hearing aid device like the one shown in FIG. 6A.
Figure 6A:
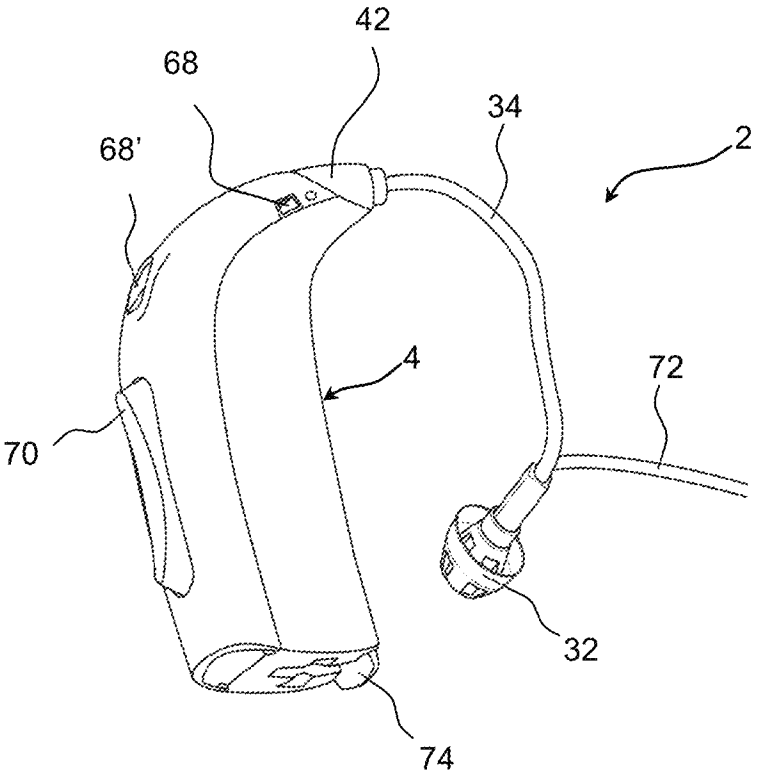
FIG. 6A shows a perspective view of a hearing aid device according to the disclosure.

FIG. 6A illustrates a perspective view of a hearing aid device 2 according to the disclosure. The hearing aid device 2 is a RITE hearing aid device 2 comprising a housing 4 and a connection member 42 that is attached to the housing 4.

The housing 4 comprises a volume control 70, microphone openings 68, 68' and a battery door 74.

A tube 34 enters the housing 4 of the hearing aid device 2 via the connection member 42. A dome 32 is attached to the distal end of the tube 34. Moreover, a retention strip 72 is provided at the distal end of the tube 34. An antenna may be arranged in the hearing aid device 2 in different ways.

FIG. 6B illustrates schematically a perspective view of a tube 34 and a connection member 42 of the type that is intended to be used in a RITE hearing aid device 2 like the one shown in FIG. 6A.

A basically cylindrical head member 76 is provided at the proximal end of the tube 34. Outer threads 78 are provided at the outer surface of the head member 76. Accordingly, the head member 76 is configured to be detachably attached to the connection member 42 as indicated by the arrow 71.

The connection member is provided with a cavity 80 configured to receive the head member 76. Thus, the geometry of the cavity 80 fits the geometry of the head member 42. Moreover, the cavity 80 is provided with inner threads 82 that are adapted to receive the outer threads 78 of the head member 76. Accordingly, the head member 76 can be screwed into the connection member 42 so that a firm and reliable attachment of the head member 76 to the connection member 42 can be provided in an easy and secure manner.

The connection member 42 comprises a support arm 84 that is provided as extension of the connection member 42. The support arm 84 is configured to be mechanically (detachably) attached to the tube 34 by means of two holding arms 86, 86' that are provided at the distal end of the support arm 84. Each of the holding arms 86, 86' are shaped as a portion (about one third or 120 degrees) of a hollow circular cylinder. The holding arms 86, 86' are arranged in such a way that they constitute an attachment space 88 provided between the holding arms 86, 86'. The attachment space 88 is configured to receive and hereby secure the tube 34 to the support arm 84.

An antenna 20 extends along the length of the support arm 84. The antenna 20 extends through the connection member 42 and has further more a protruding portion 90 protruding from the proximal end of the connection member 42. The protruding portion 90 is configured to be electrically connected to interior members of the housing 4 of a hearing aid device 2.

The antenna 20 may be attached to the support member by any suitable means. The antenna 20 may be attached to the support member by means of gluing by way of example. The antenna 20 may be integrated into the support member 84 and the connection member 42 while injection moulding the support member 84 and the connection member 42 by way of example.

Figure 7B:
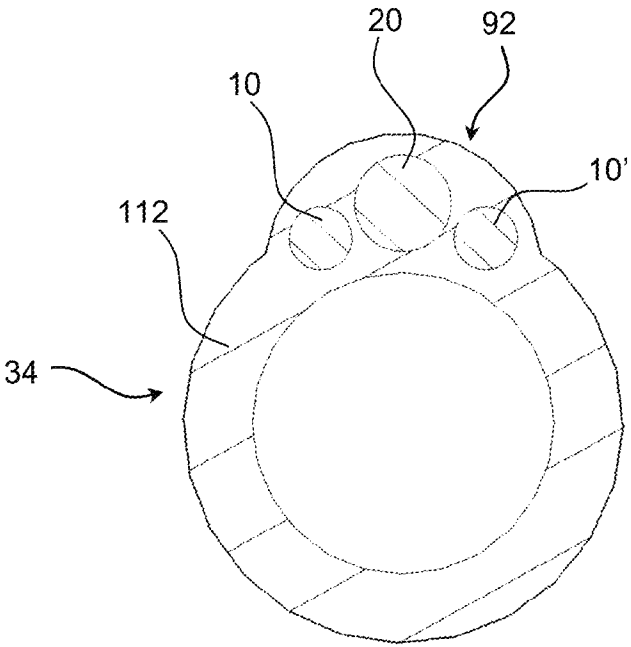
FIG. 7B shows a cross-sectional view of another tube of a hearing aid device 2 according to the disclosure.
Figure 7A:
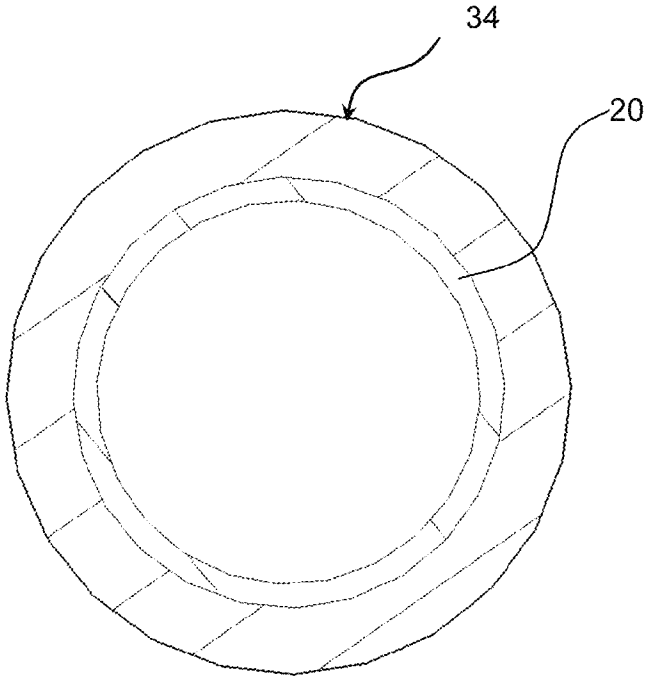
FIG. 7A shows a cross-sectional view of a tube of a hearing aid according to the disclosure.

FIG. 7A illustrates a cross-sectional view of a tube 34 of a hearing aid according to the disclosure. The tube 34 has a circular cross-section and may be a tube in a RITE hearing aid device 2 or in a BTE hearing aid device. A thin antenna 20 is provided at the inner surface of the tube 34. The antenna 20 may be provided as a film.

The antenna 20 may be attached to the tube 34 in any suitable way. The tube 34 may be produced by extrusion.

FIG. 7B illustrates a cross-sectional view of another tube 34 of a hearing aid device 2 according to the disclosure, e.g. a RITE hearing aid device 2 or in a BTE hearing aid device 2. The tube 34 has a basically circular cross-section, however it is provided with an increased thickness portion 92 in which a first thin lead 10, a second thin lead 10' and a third thicker antenna 20 are provided. The leads 10, 10' and the antenna 20 are embedded in the wall of the tube and extend along the length of the tube 34.

FIGS. 8A-8D illustrates schematically a cross-sectional exploded view of a RITE hearing aid device 2 according to the disclosure.

Figures 8A, 8B, 8C, 8D:
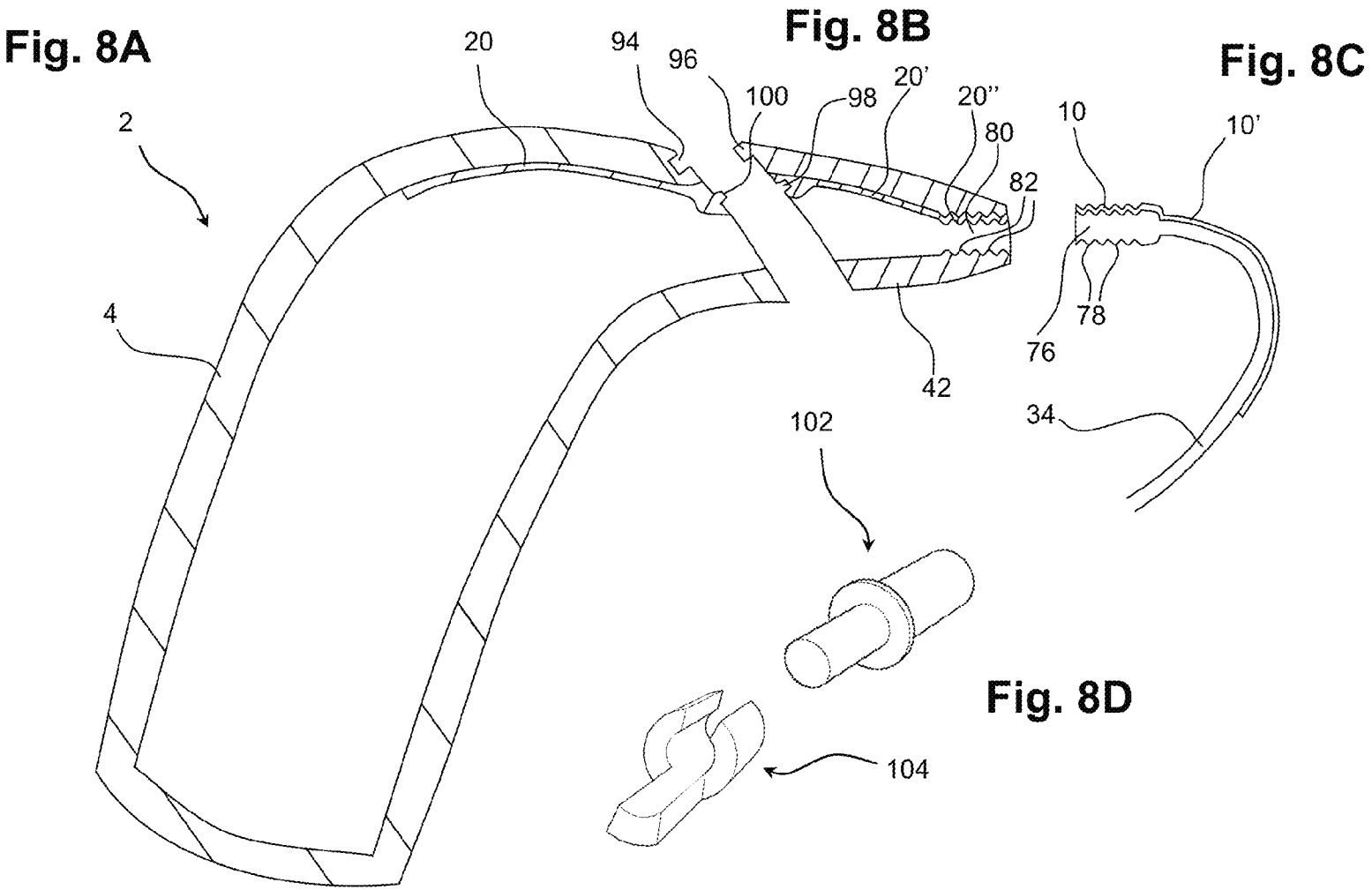
FIGS. 8A-8D shows schematically a cross-sectional exploded view of a RITE hearing aid device according to the disclosure.

FIG. 8A illustrates schematically a cross-sectional view of the housing 4 of the hearing aid device 2. The members housed in the housing (receiver, amplifier, microphone) are removed for illustrative purposes. In practice the housing 4 would contain a number of essential elements like the one illustrated in FIG. 1A and in FIGS. 2A-2B.

FIG. 8C illustrates schematically a cross-sectional view of a tube member 34 having a head member 76 provided with outer threads 78. An antenna 10 covers a portion of the threads 78 of the head member 76. This antenna 10 is electrically connected to an antenna 10' that is attached to the outer surface of the tube 34.

FIG. 8B illustrates schematically a cross-sectional view of a connection member 42 having a first open end configured to be attached to the housing 4. The connection member 42 has a second open end and a cavity 80 configured to receive the tube 34. The cavity 80 is provided with inner threads 82 configured to receive the threads 78 of the head member 76. A first antenna 20' is provided at the proximal and central portion of the upper inside surface of the connection member 42. The first antenna 20' is electrically connected to a second antenna 20" that covers a portion of threads 82 of the connection member 42.

A groove member 98 is provided in the first antenna 20' and this groove member 98 is configured to receive a corresponding tongue member 100 provided in the antenna 20 of the housing 4. A tongue member 96 is provided in the proximal end of the connection member 42 and a groove member 94 corresponding to the tongue member 96 is provided in the housing 4. The connection member 42 is configured to be mechanically and electrically connected to the housing 4 of the hearing aid device 2 by means of the tongue members 96, 100 and the corresponding groove members 94, 98.

When the hearing aid device 2 is assembled, the antennas 20, 20', 20", 10, 10' are electrically connected to form one large antenna capable for being used to perform wireless communication with an external device (e.g. a mobile phone).

Some of the tongue members 96, 100 and the corresponding groove members 94, 98 may be replaced by other attachment members or plug members.

FIG. 8D illustrate a perspective view of a male connection member 102 and a corresponding female connection member 104 configured to receive the male connection member 102. This connection may replace the connection between the antenna 20 and the antenna 20' shown in FIG. 8A. In practice various other means may be used to connect the antenna 20 and the antenna 20'.

Figure 9B:
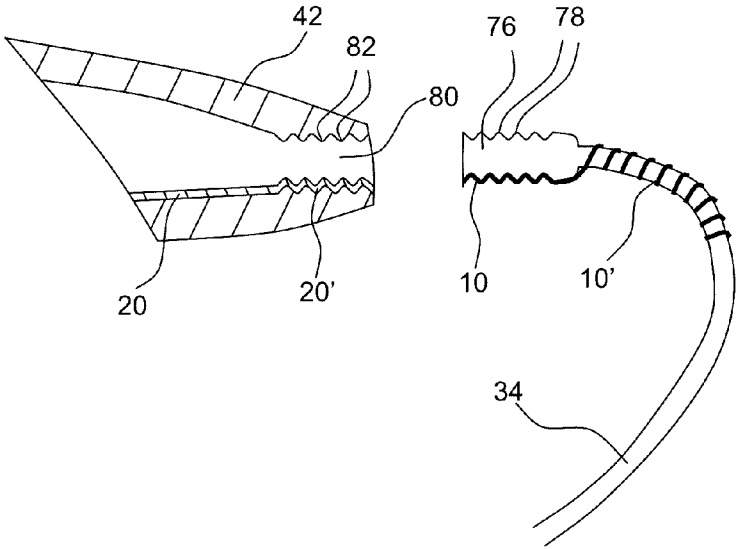
FIG. 9B shows schematically a cross-sectional view of a connection member similar to the one shown in FIG. 9A.
Figure 9A:
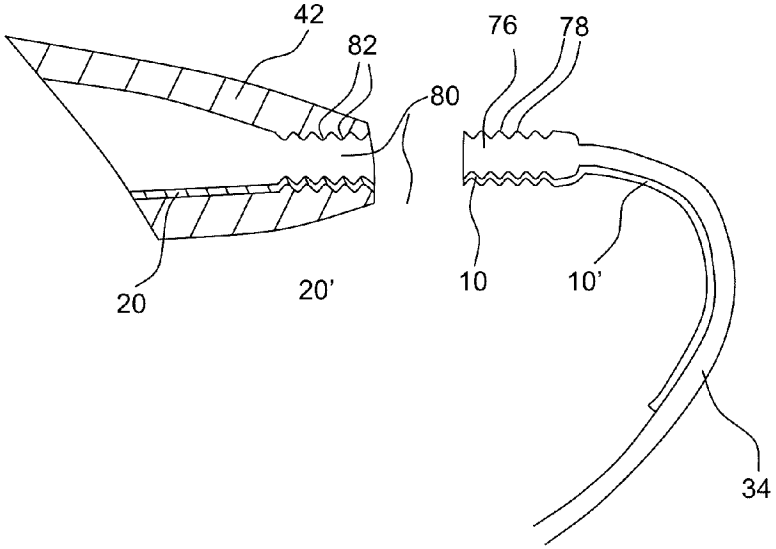
FIG. 9A shows schematically a cross-sectional view of connection member and a corresponding tube for a hearing aid device according to the disclosure.

FIG. 9A illustrates schematically a cross-sectional view of connection member 42 and a corresponding tube 34 for a hearing aid device according to the disclosure.

The connection member 42 has a first opening end configured to be attached to a housing of a hearing aid device. The connection member 42 has a second open end and a cavity 80 configured to receive the head member 76 of the tube 34. The cavity 80 is provided with inner threads 82 configured to receive the threads 78 of the head member 76. A first antenna 20' is provided at the proximal and central portion of the lower inside surface of the connection member 42. The first antenna 20 is electrically connected to a second antenna 20' that extends along the threads 82 of the connection member 42.

A first antenna 10 extends along the threads 78 of the head member 76 and is electrically connected to a second antenna 10' that is attached to the tube 34. The tube 34 is attached to the connection member 42 by screwing the head member 42 into the cavity 80 of the connection member 42.

FIG. 9B illustrates schematically a cross-sectional view of a connection member 42 similar to the one shown in FIG. 9A and another corresponding tube 34 for a hearing aid device according to the disclosure.

The tube 34 is attached to a head member 76 provided with threads 78 configured to be received by the inner threads 82 of the connection member 42. A first antenna 10 extends along the threads 78 of the head member 76 and is electrically connected to a second antenna 10' that is provided at the outside surface of the tube 34. The second antenna 10' is twisted around the tube 34 to form a coil-like member. Hereby, the second antenna 10' takes up less space than the straight second antenna 10' shown in FIG. 9A.

The second antenna 10' may be attached to the tube 34 by any suitable means. The second antenna 10' may be attached to the tube 34 by means of glue, mechanical attachment means or simply be the compressive (radial inwardly directed) forced provided when twisting the antenna 10' around the tube 34.

Figure 10E:
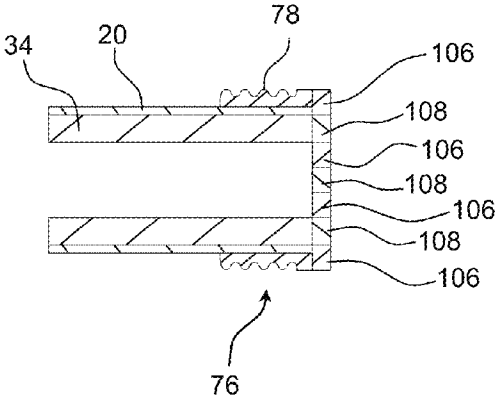
FIG. 10E illustrates schematically a cross-sectional side view of a tube according to the disclosure.
Figure 10C:
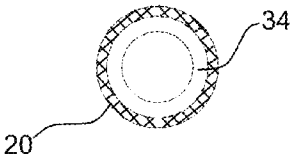
FIG. 10C shows schematically a front view of another tube of a RITE hearing aid device according to the disclosure.
Figure 10D:
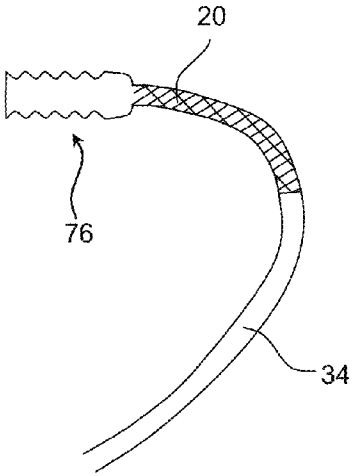
FIG. 10D shows schematically a side view of the tube shown in FIG. 10C.
Figure 10A:
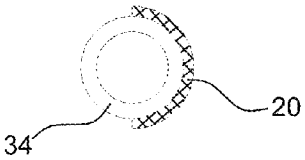
FIG. 10A shows schematically a front view of a tube of a RITE hearing aid device according to the disclosure.

FIG. 10A illustrates schematically a front view of a tube 34 of a RITE hearing aid device according to the disclosure. The tube 34 has a circular cross-section and an antenna 20 is provided at the outside surface of the tube 34.

Figure 10B:
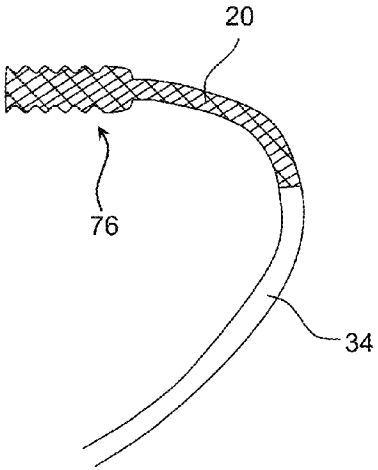
FIG. 10B shows schematically a side view of the tube shown in FIG. 10A.

The antenna 20 extends along the length of the tube (see FIG. 10B). The antenna coves basically the one half of the outside surface of the tube 34. The antenna 20 may be ITO coating or any other suitable type of antenna.

FIG. 10B illustrates schematically a side view of the tube 34 shown in FIG. 10A. It can be seen that the antenna 20 extends from the head member 76 along the proximal portion of the tube 34.

FIG. 10C illustrates schematically a front view of another tube 34 of a RITE hearing aid device according to the disclosure. The tube 34 has a circular cross-section and an antenna 20 covers the entire outside surface of the tube 34. Thus, the antenna 20 encloses the tube 34. The antenna 20 may be an ITO coating or any other suitable type of antenna.

FIG. 10D illustrates schematically a side view of the tube 34 shown in FIG. 10C. The head member 76 is provided outside the antenna 20. Accordingly, the antenna 20 extends along the inside of the head member 76 and extends further along the proximal portion of the tube 34.

FIG. 10E illustrates schematically a cross-sectional side view of a tube 34 according to the disclosure. The tube 34 corresponds to the one illustrated in FIG. 10C and in FIG. 10D. An antenna 20 that may be shaped as an ITO coating is attached to the outside of the tube 34. It can be seen that the antenna 20 extends under the head member 76 with the threads 78.

The head member 76 is open at its distal end and in this portion of the tube 34 a number of electrically conductive members 106 and electrically insulating members 108 are provided side by side. This end portion of the head member 76 is configured to be connected to a corresponding plug member (not shown) provided at the connection member (not shown).

Figure 11B:
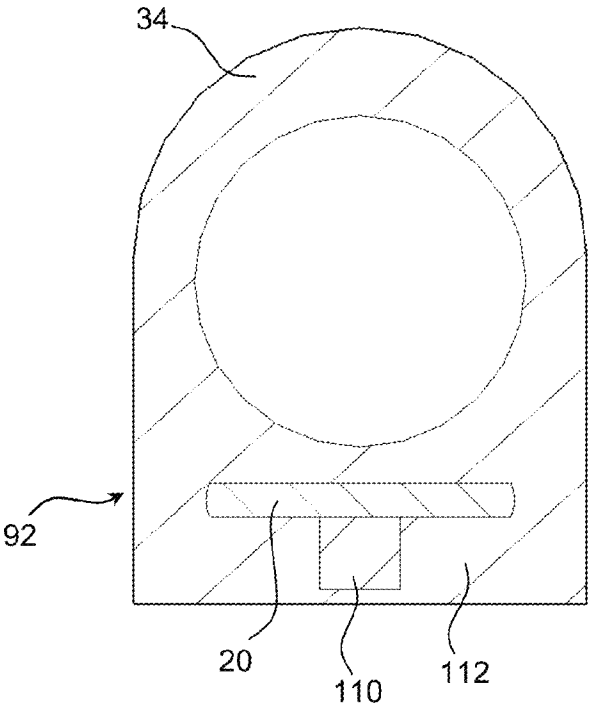
FIG. 11B illustrates schematically a cross-sectional front view of the tube shown in FIG. 11A.
Figure 11A:
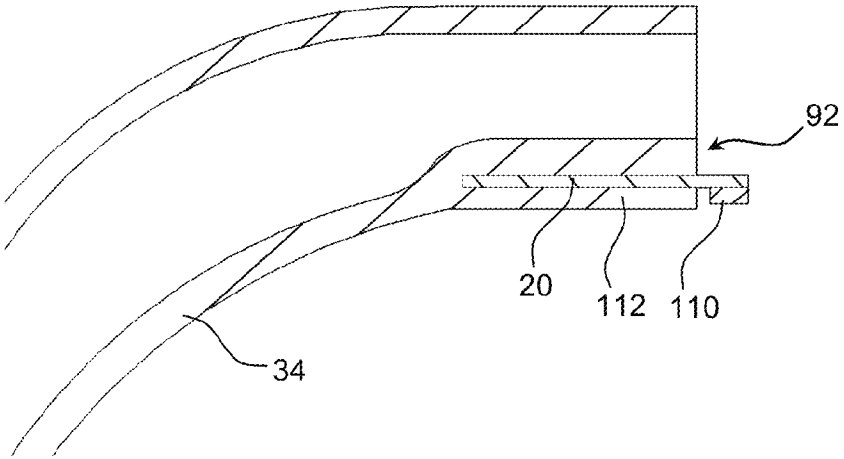
FIG. 11A illustrates schematically a cross-sectional side view of another tube according to the disclosure.

FIG. 11A illustrates schematically a cross-sectional side view of a tube 34 according to the disclosure. The tube 34 is flexible and comprises an increased thickness portion 92 at its distal end. A flat plate-shaped antenna 20 is embedded in the wall 112 of the increased thickness portion 92 of the tube 34.

A box-shaped 110 connection body 110 is attached to the underside of the distal portion of the antenna 20. The distal end surface of the antenna 20 and the connection body 110 are aligned. The connection body 110 may be a gold pad.

FIG. 11B illustrates schematically a cross-sectional front view of the tube 34 shown in FIG. 11A. It can be seen that the antenna 20 is rather flat and plate-shaped and that it is centrally arranged within the wall 112 of the increased thickness portion 92 of the tube 34. The box-shaped connection body 110 is centrally attached to the lower side of the distal portion of the antenna 20.

Figure 12B:
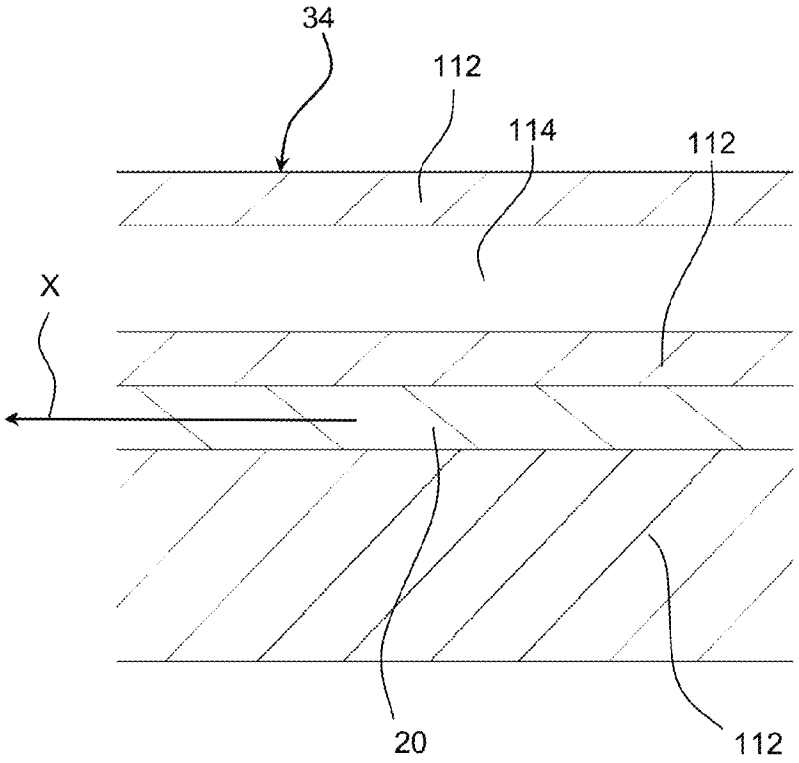
FIG. 12B shows schematically a cross-sectional view along the longitudinal axis of the tube shown in FIG. 12A.
Figure 12A:
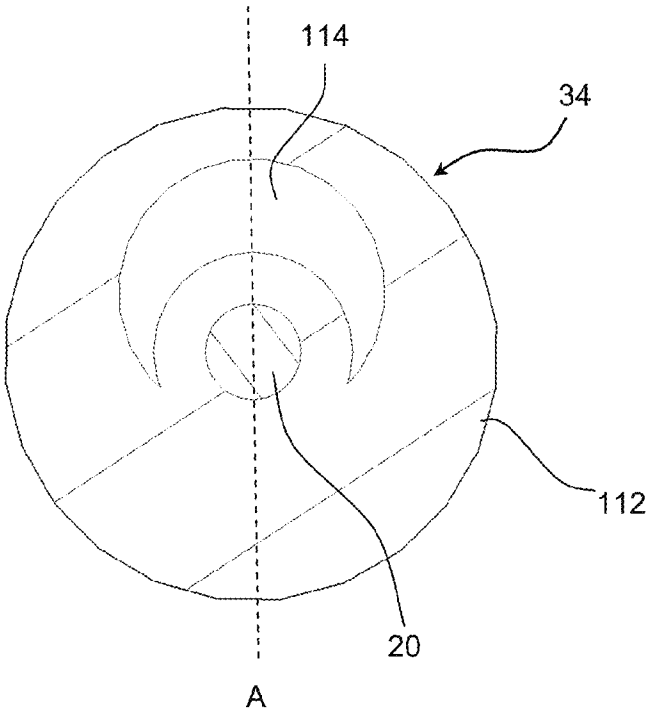
FIG. 12A shows schematically a cross-sectional front view of a tube according to the disclosure.

FIG. 12A illustrates schematically a cross-sectional front view of a tube 34 according to the disclosure. The tube 34 comprises walls 112 and has a circular cross-section and comprises a centrally arranged antenna 20 having a circular cross-section. A space 114 is provided in the tube 34. The antenna 20 may be a litz wire antenna 20. The mid axis A is indicated with a vertical dotted line.

FIG. 12B illustrates schematically a cross-sectional view along the longitudinal axis X of the tube 34 shown in FIG. 12A. The cross-section is made at the mid axis A indicated in FIG. 12A. It can be seen that the antenna 20 is centrally arranged and that a space 114 is provided in the tube 34. The space 114 is configured to transfer air-borne acoustic sound.

Figure 13B:
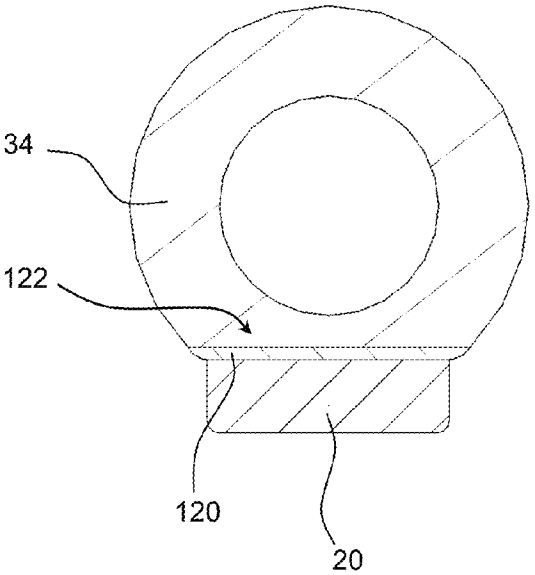
FIG. 13B shows schematically a cross-sectional view of another tube according to the disclosure.
Figure 13A:
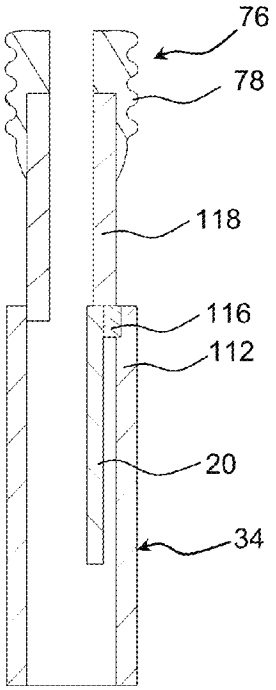
FIG. 13A shows schematically a cross-sectional view of a tube and a head member according to the disclosure.

FIG. 13A illustrates schematically a cross-sectional view of a tube 34 and a head member 76 according to the disclosure. The head member 76 is provided with threads 78 for being screwed into a threaded connection member (not shown). The head member 76 is attached to a cylindrical pipe member 118. An antenna 20 is attached to the pipe member 118. The antenna 20 is arranged in the pipe 34 and a knife member 116 has been inserted into the wall 112 of the tube 34. The pipe member 118 may be made in an electrically conductive material in order to provide an electrical connection to the housing of the hearing aid device. The head member 76 may comprise an electrical connection portion suitable of providing an electrical connection to the housing of the hearing aid device.

FIG. 13B illustrates schematically a cross-sectional view of another tube 34 according to the disclosure. The tube 34 has a basically circular cross-section. The tube 34 is, however, provided with a flat portion 122 configured to receive a plate-shaped antenna 20. The antenna 20 is attached to the flat portion 122 of the tube 34 by means of glue 120. Accordingly, the antenna 20 extends along the outside surface of the tube 34.

It is possible to provide the antenna 20 with a coating, e.g. a protective coating (not shown).

FIG. 13C illustrates schematically a cross-sectional view of yet another tube 34 according to the disclosure. The tube 34 is flexible and has been bend into an S-shape. The tube 34 comprises a wall 112 and an antenna 20. The antenna 20 may comprise so-called "Kevlar antenna wire" comprising continuous filament aramid and tinned copper wire braid. The antenna 20 may comprise metal fibres and para-aramid synthetic fiber (known as the registered trademark Kevlar).

The antenna 20 may be embedded in the wall 112 of the tube or be attached to the wall 112 of the tube 34 either inside or outside the tube 34. Any suitable attachment method may be used.

Figure 14A:
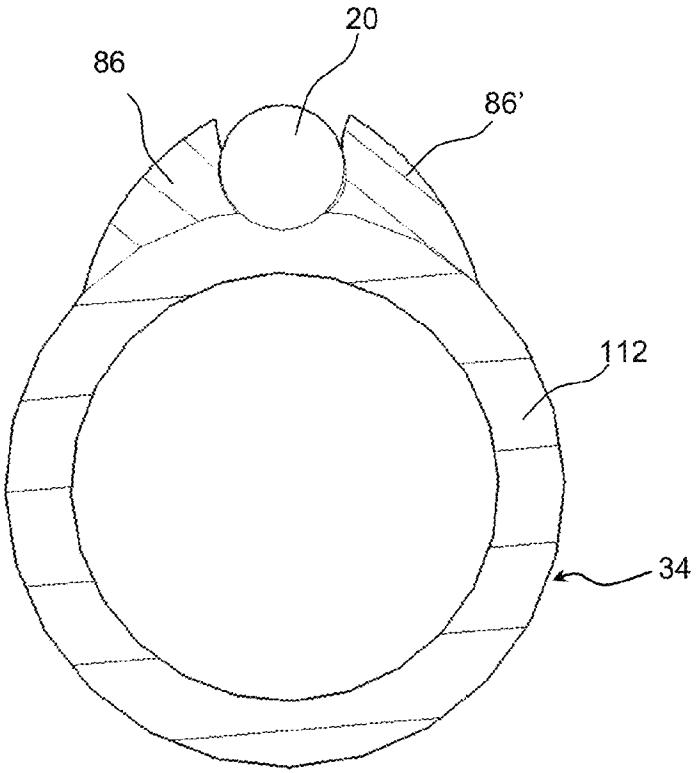
FIG. 14A shows schematically a cross-sectional view of a tube according to the disclosure.

FIG. 14A illustrates schematically a cross-sectional view of a tube 34 according to the disclosure. The tube 34 has a basically circular cross-section. A pair of holding arms 86, 86' are provided at the outer surface of the tube 34. The holding arms 86, 86' are configured to receive and maintain an antenna 20 secured to the tube 34.

The antenna 20 has a circular cross section and is attached to the tube 34 by pressing the antenna 20 into the space provided between the two holding arms 86, 86' by means of a interference fit.

FIG. 14B illustrates schematically a side view of a housing 4 of a hearing aid according to the disclosure. A connection member 42 is attached to the housing 4 and a tube 34 is inserted into the housing 4 through the connection member 42. An antenna 20 extends from the housing 4, through the connection member 43 and further along the proximal portion of the tube 34. The antenna 20 is indicated with a dotted line.

Figure 15B:
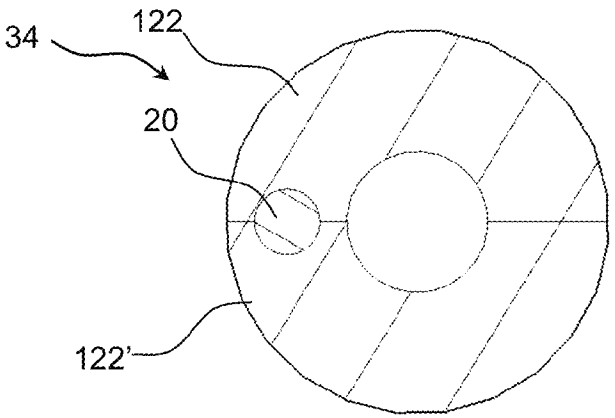
Figure 15A:
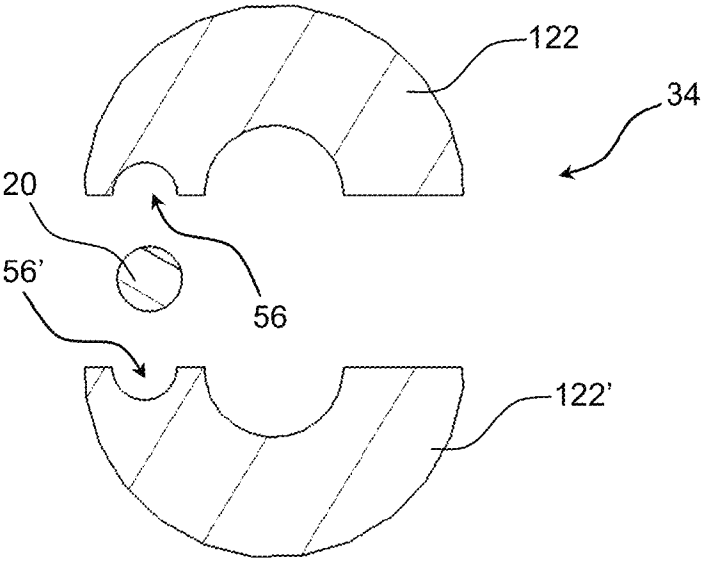

FIGS. 15A-B illustrates two schematically cross-sectional views of a tube 34 according to the disclosure. The tube 34 comprise a first half 122 and a second half 122' that are configured to be joint.

A first recess 56 is provided in the first half 122 and a second recess 56' is provided in the second half 122'. An antenna 20 having a circular cross section is shown.

In FIG. 15A the two half's 122, 122' are completely separated from each other and the antenna 20 is arranged between the two half's 122, 122'.

In FIG. 15B the two half's are put together to form a tube 34 in which the antenna 20 is attached. It is possible to glue the two half's together or to join the by using any other suitable method.

LIST OF REFERENCE NUMERALS

2—Hearing aid device
4—Housing
4.1—add on device
6—Hook
8—Microphone
10, 10'—Antenna
12—Receiver
14—Battery
16—Lower side
18—Upper side
20, 20', 20"—Antenna
22—Microphone
24—Amplifier
26—Receiver
28—End
30—Hook
32—Dome
34—Tube
36—Proximal end
38—Ear mould
40—Bore
42—Connection member
44, 44'—External device
46—Connection body
48—Protruding portion
50—Ring member
52—Connection member
54—Coaxial sleeve

56, 56'—Recess
58—Rib
60—Tube
62—Sound outlet
64—Ventilation opening
66—Ear mould
68, 68'—Microphone opening
70—Volume control
72—Retention strip
74—Battery door
76—Head member
78—Thread
80—Cavity
82—Thread
84—Support arm
86, 86'—Holding member
88—Attachment space
90—Protruding portion
92—Increased thickness portion
94—Groove member
96—Tongue member
98—Groove member
100—Tongue member
102—Male connection member
104—Female connection member
106—Electrically conductive member
108—Electrically insulation member
110—Connection body
112—Wall
114—Sound space
116—Knife member
118—Pipe member
120—Glue
122, 122'—Half
124—Wall
A—Axis
X—Longitudinal axis

The invention claimed is:

1. A hearing aid device configured to communicate wirelessly with an external device, the hearing aid device comprising:
a housing with a microphone and an amplifier;
an antenna;
a tube configured to deliver sound acoustically from a receiver in the housing to an ear mold or a dome or electrically to a receiver in the ear mold or the dome; a connection member having a cavity configured to receive the tube; and
a support arm configured to support and fixedly secure the antenna to the tube, wherein
the support arm is an extension of the connection member, and
the antenna extends along at least a portion of the tube.

2. The hearing aid device according to claim 1, wherein the antenna comprises several separate antenna members that are electrically connected to each other to form one interconnected antenna.

3. The hearing aid device according to claim 1, wherein the antenna comprises an antenna portion formed as a coaxial sleeve encasing at least a portion of a tube.

4. The hearing aid device according to claim 1, wherein the antenna is provided in a recess in the tube.

5. The hearing aid device according to claim 1, wherein the antenna is provided at an inner surface of the tube.

6. The hearing aid device according to claim 1, wherein
the tube has a basically circular cross-section, and
the antenna is embedded in a wall of the tube and extends along the length of the tube.

7. The hearing aid device according to claim 1, wherein
the hearing aid device comprises the tube having a head member provided with outer threads,
the antenna covers a portion of the threads of the head member,
the antenna is electrically connected to another antenna member that is attached to an outer surface of the tube,
the hearing aid device further comprises a connection member having a cavity configured to receive the tube,
the cavity is provided with inner threads configured to receive the threads of the head member,
a first antenna member extends through the connection member, and
the first antenna member is electrically connected to a second antenna that covers a portion of threads of the connection member.

8. The hearing aid device according to claim 7, wherein
the housing includes a housing antenna member,
a groove member is provided in the first antenna member, and
the groove member is configured to receive a corresponding tongue member provided in the housing antenna member.

9. A hearing aid device configured to communicate wirelessly with an external device, the hearing aid device comprising:
a housing with a microphone and an amplifier;
an antenna;
a tube configured to deliver sound acoustically from a receiver in the housing to an ear mould or a dome or electrically to a receiver in the ear mould or the dome;
a head member provided with threads configured for being screwed into a threaded connection member;
a pipe member, where the antenna is attached to the pipe member; and
a knife member, wherein
the antenna is configured to be arranged in the pipe by inserting the knife member into a wall of the tube, and
the antenna extends along at least a portion of the tube.

10. A hearing aid device configured to communicate with an external device, the hearing aid device comprising:
a housing with a microphone and an amplifier;
an antenna including a first antenna member and a second antenna member;
a tube configured to deliver sound acoustically from a receiver in the housing to an ear mould or a dome or electrically to a receiver in the ear mould or a dome, the tube being attached to a head member having threads, which head member is configured to be received by inner threads of a connection member; and
the connection member, wherein
the first antenna member extends along the threads of the head member and is electrically connected to the second antenna member that is provided at the outside surface of the tube, and
the antenna extends along at least a portion of the tube.

11. The hearing aid device according to claim 1, wherein
the hearing aid device comprises the tube having a head member,
the antenna is provided at the outside surface of the tube, and
the antenna extends along the length of the tube from the head member along the proximal portion of the tube.

12. The hearing aid device according to claim 1, wherein the hearing aid device comprises the tube, and a flat plate-shaped antenna is embedded in a wall of an end portion of the tube.

13. The hearing aid device according to claim 1, wherein the hearing aid device comprises the tube, a pair of holding arms are provided at an outer surface of the tube, and the holding arms are configured to receive and maintain the antenna secured to the tube.

14. The hearing aid device according to claim 2, wherein the antenna is provided in a recess in tube.

15. The hearing aid device according to claim 3, wherein the antenna is provided in a recess in the tube.

16. The hearing aid device according to claim 1, wherein the support arm is terminated with a partial cylinder defining a hollow space sized to receive the tube.

* * * * *